US010533279B2

(12) United States Patent
Ellis et al.

(10) Patent No.: US 10,533,279 B2
(45) Date of Patent: Jan. 14, 2020

(54) METHOD OF DYE CLEARING TEXTILES

(71) Applicant: NIKWAX LIMITED, Wadhurst (GB)

(72) Inventors: David John Ellis, Burgess Hill (GB); Nicholas Brown, Ticehurst (GB)

(73) Assignee: NIKWAX LIMITED (GB)

( * ) Notice: Subject to any disclaimer, the term of this patent is extended or adjusted under 35 U.S.C. 154(b) by 0 days.

(21) Appl. No.: 16/068,126

(22) PCT Filed: Jan. 4, 2017

(86) PCT No.: PCT/EP2017/050163
§ 371 (c)(1),
(2) Date: Jul. 4, 2018

(87) PCT Pub. No.: WO2017/118671
PCT Pub. Date: Jul. 13, 2017

(65) Prior Publication Data

US 2019/0024305 A1 Jan. 24, 2019

(30) Foreign Application Priority Data

Jan. 4, 2016 (GB) ..... 1600098.6

(51) Int. Cl.

| | |
|---|---|
| ***D06P 5/02*** | (2006.01) |
| ***D06P 5/04*** | (2006.01) |
| ***D06P 1/653*** | (2006.01) |
| ***D06P 3/52*** | (2006.01) |

(52) U.S. Cl.
CPC ..... *D06P 5/04* (2013.01); *D06P 1/6533* (2013.01); *D06P 3/52* (2013.01)

(58) Field of Classification Search
CPC .. D06P 5/02; D06P 65/02; D06P 1/221; D06P 5/2077; D06P 5/2066; D06P 5/2038; D06P 1/67333; D06P 3/52
See application file for complete search history.

(56) References Cited

U.S. PATENT DOCUMENTS

| | | | | | |
|---|---|---|---|---|---|
| 3,619,111 | A * | 11/1971 | Rowe | D06L 1/14 | 8/111 |
| 4,003,880 | A * | 1/1977 | Sidebotham | C08J 11/08 | 528/487 |
| 4,118,187 | A * | 10/1978 | Sidebotham | C08J 11/08 | 264/37.28 |
| 4,137,393 | A * | 1/1979 | Sidebotham | C08J 11/08 | 521/48 |
| 4,286,961 | A * | 9/1981 | Buser | D06P 5/02 | 8/110 |
| 8,475,538 | B2 * | 7/2013 | Baum | D06P 1/52 | 8/115.51 |

FOREIGN PATENT DOCUMENTS

| | | | | |
|---|---|---|---|---|
| CN | 104562790 | A | 4/2015 | |
| DE | 2739092 | A1 | 8/1977 | |
| ES | 2225985 | T3 | 9/1999 | |
| GB | 2059975 | A | 4/1981 | |
| JP | 291285 | A | 3/1990 | |
| WO | 9812373 | A1 | 3/1998 | |
| WO | WO 2010/018073 | A1 * | 2/2010 | D06P 1/60 |

OTHER PUBLICATIONS

English Translation of the abstract of the Patent No. JP405287687A (dated Jun. 29, 2019).*
English transaltion of the Patent No. CN104562790 A (dated Apr. 29, 2015).*
International Search Report in International Application No. PCT/EP2017/050163 dated Apr. 11, 2017.
Written Opinion in International Application No. PCT/EP2017/050163 dated Apr. 11, 2017.
International Preliminary Report on Patentability in International Application No. PCT/EP2017/050163 dated Mar. 20, 2018.

* cited by examiner

*Primary Examiner* — Eisa B Elhilo
(74) *Attorney, Agent, or Firm* — Heslin Rothenberg Farley & Mesiti P.C.

(57) ABSTRACT

A process to remove excess dye from dyed polyester fabric comprising adding a solution of a weak organic acid to the fabric in a dyeing vessel, raising the temperature in the vessel to at least 80° C., allowing the acid to react with the fabric for at least 6 minutes and removing all liquid.

23 Claims, No Drawings

METHOD OF DYE CLEARING TEXTILES

CROSS REFERENCE TO RELATED APPLICATIONS

This application is a U.S. National Phase filing under 35 U.S.C. § 371 of International Application PCT/EP2017/050163, filed Jan. 4, 2017, and published as WO 2017/118671 A1 on Jul. 13, 2017. PCT/EP2017/050163 claims priority from Great Britain application number 1600098.6, filed Jan. 4, 2016. The entire contents of each of these prior applications are hereby incorporated herein by reference.

TECHNICAL FIELD

The present invention relates to a process to remove excess dye from dyed polyester fabric. In particular it relates to the use of a weak organic acid, such as ascorbic acid or citric acid, to remove the excess dye.

BACKGROUND

Commercial dyeing of textiles or fabrics usually consists of immersing the fabric in a dye bath containing an appropriate solution of the dyestuff until the desired shade is reached through absorption of the dye onto the fabric. As there are numerous variables that can alter the efficiency of absorption of the dye it is conventional to add more dyestuff to the dye bath than is required and to control the extent or depth of dyeing by time. The consequence of this approach is that further steps are required to remove excess unfixed dye from the fabric after dyeing has been completed. Without the removal of the excess dye problems such as dye run or transfer from the finished article may occur. In addition, it may lead to downstream contamination of the processing plant.

Dyeing of polyester fabric is not particularly easy as the nature of the fibres of the component polymer is such that they are extremely hydrophobic. In addition, the fibres are not dissolved or degraded by organic solvents. In order to achieve effective dyeing of polyester fabric it has been necessary to use specialist dyestuffs and harsh conditions in specialised equipment.

Polyester fabric is typically dyed using disperse dyes. Disperse dyes are ready made dyes that do not have any ionic character and as such they are insoluble or only poorly soluble in water under ambient conditions. Such dyes are utilised in the dyeing process by dispersing them in acidified water at elevated temperatures, e.g. 80° C. to 100° C., or at both elevated temperature and pressure, e.g. 105° C. to 140° C. and 1.1 to 3.6 bar. Such conditions result in the dye diffusing into the plasticized polyester fibres to form a molecular dispersion in the polymer matrix.

Dispersing agents and carrier chemicals are commonly used in the dyeing of polyester fabric. Dispersing agents are needed to keep the bulk of the poorly soluble disperse dye in an homogeneous state throughout the dyebath liquor. Such dispersing agents are typically strong surfactants such as alkylsulphonates and alkylarylsulphonates. Carrier chemicals are substances that are designed to swell the fibres and help facilitate the diffusion of the disperse dye into the fabric. Typical carrier chemicals that may be used are based on glycol ethers.

Once sufficient colour strength has been achieved on the fabric it is necessary to remove excess dye. As the dyeing of polyester fabric with disperse dyes is a diffusion process there will be a certain accumulation of dye adsorbed onto the surface of the fabric which has not diffused into the bulk of it. This accumulation of dye will have a more tenuous attachment to the fabric resulting in problems in the finished cloth, such as undermining the shade of the fabric. It may also affect the washing and rubbing fastness of the dye.

The process of removing excess dye that serves to eliminate these problems is called reduction clearing. Reduction clearing usually uses a strong reducing agent at a high temperature and pH to remove excess dye. The most commonly used reagent in reduction clearing is sodium dithionite in the presence of sodium hydroxide. This reagent has several disadvantages, not least its reactivity which leads to complications in handling. It is unstable in non-alkaline conditions where decomposition will occur, even resulting in spontaneous combustion. Another disadvantage of using sodium dithionite is that it acts as a sulphonating agent that can act on any residual surfactants remaining in the fabric. This can result in any residual surfactants becoming persistent. Use of such sulphur containing compounds also suffers from the disadvantage that as the compounds are not readily biodegradable the waste water from the process needs to be extensively treated before it can be returned to watercourses.

U.S. Pat. No. 6,730,132 discloses a process for reduction clearing of polyester textiles that comprises adding to the acidic dyeing liquor or wash bath an after-treatment composition comprising dithionite/acid acceptor sulphinate optionally mixed with sulphonate.

It has now been found that by adding a weak organic acid or a salt thereof, such as ascorbic acid or citric acid, or a salt thereof, as the reduction clearing agent to the dyed polyester fabric, preferably following the removal of dyeing liquor, heating for a period of time and subsequently removing the liquid, excess dye is readily removed from the dyed polyester fabric without the need to use sulphur-containing compounds.

SUMMARY OF INVENTION

According to the invention there is provided a process to remove excess dye from dyed polyester fabric comprising adding a solution of a weak organic acid or a salt thereof to the fabric in a dyeing vessel, raising the temperature and allowing the acid or salt thereof to remain in contact with the fabric for a period of time, followed by removal of all liquid.

DESCRIPTION OF EMBODIMENTS

The weak organic acid is a Brønsted acid that contains at least 4 carbon atoms, and which has a $pK_a$ or $pK_{a1}$ value of at least 1, and preferably a $pK_a$ or $pK_{a1}$ value of less than 5. A preferred $pK_a$ or $pK_{a1}$ range is from 3 to 4.5. The $pK_{a1}$ value refers to the first dissociated proton for multiprotonic acids. Examples of such acids include ascorbic acid, citric acid, caprylic acid, adipic acid, succinic acid, maleic acid and butyric acid. Preferred examples are ascorbic acid and citric acid. Salts of the weak organic acid can also be used. Examples of salts include those having monovalent cations, such as alkali metal salts. Preferred salts are sodium or potassium salts. Ascorbic acid or a salt thereof is most preferred. One or more weak organic acids and/or salts thereof can be used.

In the discussion that follows, unless specified otherwise, reference to "weak organic acid" or examples thereof also includes a reference to their salts.

The temperature in the vessel is preferably raised to a value in the range of from 60° C. to 100° C., most preferably from 75° C. to 80° C. or at least 80° C.

The weak organic acid is preferably maintained in contact with the fabric for at least 6 minutes to allow it to react with the dyed fabric. Preferably, the contact time is up to 60 minutes.

Preferably the dyeing liquor is removed from the dyeing vessel prior to adding the weak organic acid. Alternatively, if an already dyed polyester fabric is exhibiting low dye fastness it is possible to reprocess the dyed fabric using the process of the invention in order to remedy the problem. In this situation the dry dyed fabric may be loaded into a dye bath or suitable vessel to which may be added water and an appropriate amount of the weak organic acid.

The organic acid is added at a rate of 80 g to 120 g per litre, if for example the dyeing liquor is not removed before the organic acid is added. Alternatively, if the dyeing liquor is removed before adding the organic acid 2 g to 50 g per litre, preferably 2 g to 10 g, most preferably 5 g per litre of the acid are used.

Following the removal of all liquid the polyester fabric is preferably rinsed with water at ambient temperature, after which it is spun and dried.

In one embodiment a weak organic acid, or a salt thereof that is still acidic, is utilised as the reduction clearing agent. In contrast to the previously used reduction clearing process utilising sodium dithionite this has the advantage that it is not necessary to change the pH between the dyeing stage, which is typically carried out at a low pH, and the reduction clearing stage.

If, however, the dyed polyester fabric is to be subsequently treated, for example to render it water-repellent, then, following the reduction clearing treatment using a weak organic acid, the pH is raised to between pH 9 and pH 12. This is achieved by the addition of an alkaline hydroxide such as sodium hydroxide potassium hydroxide or ammonium hydroxide at a rate of from 1.4 g to 1.7 g per litre.

According to a second aspect of the invention there is provided the use of a weak organic acid to remove excess dye from a dyed polyester fabric wherein a solution of the weak organic acid is added to the fabric in a dyeing vessel, the temperature in the vessel is raised to at least 80° C. and the acid is allowed to react with the fabric for at least 6 minutes. All liquid is subsequently removed.

One advantage of the process of the present invention is that it avoids the need to use sulphur containing compounds, such as sodium dithionite, that act as sulphonating agents which can act on residual surfactants remaining in the fabric making the surfactants more persistent. This persistence causes problems in later textile finishing processes such as the application of water-repellent treatments to the polyester fabric.

Other advantages of using a weak organic acid in the reduction clearing process are that the process is safer to operate, less polluting of the environment as well as being cheaper to operate.

The present invention will be further described by way of reference to the following examples.

Example 1

In a suitable dyeing vessel, a dye bath was prepared to the following composition by subsequently adding, whilst under continual mixing, the components below:

Water (40° C., deionised)—5 litres

Carrier (DOWANOL EPh, Dow Chemicals)—50 g (10 g/litre)

Dispersing Agent (Basojet® PEL-200, BASF Chemicals)—50 g (10 g/litre)

Dyestuff (Permasil Red F3BS 150%, Standard Colors)—150 g (30 g/litre)

After the addition of the dyestuff, the temperature of the bath was slowly raised at a rate of approximately 1° C./minute to 95° C. At this point the pH of the dye bath was adjusted to between 4.0 and 5.0 with the addition of acetic acid (80% Technical grade)—25 g (5 g/litre).

A 500 g sample of un-dyed polyester microfibre fabric with a weight of 215 g/m$^2$ was added to the dye bath. With continual mixing, the dye bath was heated to the boil and maintained at a steady temperature for a period of 90 minutes. During this time, the pH of the dye bath was maintained by the addition of further doses of acetic acid at the rate of 5 g every 15 minutes, if necessary.

After 90 minutes, the dye bath was allowed to cool to a temperature of 60° C. before the liquid contents of the dyeing vessel were drained. The fabric was then washed in the dyeing vessel with three separate washes of Tergitol 15-S-7 (10 g in 5 litres of deionised water at 60° C. for two minutes).

The dyeing vessel was then refilled with water (5 litres of deionised water at 60° C.) and sodium hydroxide was added (20 g, 4 g/litre). The temperature of the dyeing vessel contents was then raised to 80° C. and the following was added in the prescribed order:

Dispersing Agent (Basojet® PEL-200, BASF Chemicals)—20 g (4 g/litre)

Trisodium citrate dehydrate (Jungbunzlaur)—50 g (10 g/litre)

The temperature of the dyeing vessel contents were maintained at 80° C. for a further 25 minutes. The dyeing vessel was then drained of the liquid contents. The fabric was then rinsed using five separate charges of water (5 litres of deionised water at 20° C. for two minutes). In the final rinse, the pH of the dye was lowered to between 6.0 and 7.0 with the addition of acetic acid (80% Technical grade). The dyeing vessel was then drained of the liquid contents and the dyed fabric was recovered and air dried.

The colour fastness of the final fabric was assessed using the American Association of Textile Chemists and Colorists (AATCC) test method 8-2013 (Colorfastness to Crocking: AATCC Crockometer Method) on both wet and dry samples. The results were evaluated against the AATCC Chromatic Transference Scale. Both samples were recorded as having a grade of 4.5 which indicates an acceptably low level of dye transfer from the test fabric.

Example 2

A 50 kg batch of dyed black polyester microfibre fabric (fabric weight of 150 g/m$^2$) which was showing unacceptably low dye fastness was reprocessed to remedy the problem.

The fabric was loaded into a Fong's Minitec3-1T high temperature dyeing machine. The service tank of the machine was charged with the following components in the prescribed order:

water (20° C., deionised)—150 litres sodium hydroxide—400 g ascorbic acid—750 g

Once the contents of the service tank had fully dissolved, the contents of the tank were charged into the dyeing loop. After charging, the machine jet pumping system was activated to enable the circulation of the fabric rope. The temperature of the machine content is raised using the inbuilt heater to 90° C. Circulation of the fabric was continued for a period of 60 minutes. After this time the machine jet pumping system was deactivated and the machine was emptied of liquid. The machine was then recharged via the addition of 200 litres of water (20° C., deionised) from the service tank after which the fabric was circulated with the jet pumping system for 10 minutes. The pH of the machine contents was then adjusted to 7.0 by the addition of acetic acid (80% Technical grade) via the service tank (typically 24 g/litre). The liquid contents of the machine were then drained and the fabric was removed via the service door.

After air-drying for 48 hours, the colour fastness of the final fabric was assessed using the American Association of Textile Chemists and Colorists (AATCC) test method 8-2013 (Colorfastness to Crocking: AATCC Crockometer Method) on both wet and dry samples. The results were evaluated against the AATCC Chromatic Transference Scale. Both samples were recorded as having a grade of 5 which indicates no detectable dye transfer from the sample.

The invention claimed is:

1. A process to remove excess dye from dyed polyester fabric comprising (a) adding a reduction clearing agent which is a weak organic acid or salt thereof to the fabric in a dyeing vessel, (b) raising the temperature in the vessel, (c) allowing the acid or salt thereof to remain in contact with the fabric for a period of time, (c1) raising the pH to between pH 9 and pH 12, and (d) removing all liquid.

2. The process according to claim 1 which comprises the additional step of removing dyeing liquor from the dyeing vessel prior to (a).

3. The process according to claim 1, where in step (c) the weak organic acid or salt thereof remains in contact with the fabric for at least 6 minutes.

4. The process according to claim 1, where in step (b) the temperature in the vessel is raised to a value in the range of from 60 to 100° C.

5. The process according to claim 1, in which the weak organic acid is selected from those having at least 4 carbon atoms and a $pK_a$ or $pK_{a1}$ value of at least 1.

6. The process according to claim 5 wherein the weak organic acid is ascorbic acid or salt thereof.

7. The process according to claim 6 wherein the weak organic acid is ascorbic acid.

8. The process according to claim 1 wherein the salt of the weak organic acid is selected from an alkali metal salt.

9. The process according to claim 1 comprising the additional step of rinsing the fabric with water at ambient temperature after the removal of all liquid.

10. The process according to claim 1 wherein an alkaline hydroxide is used to raise the pH.

11. The process according to claim 1 wherein the weak organic acid or salt thereof is added at a rate of from 80 g to 120 g per litre.

12. The process according to claim 2 wherein the weak organic acid or salt thereof is added at a rate of from 2 g to 50 g per litre.

13. The process according to claim 2, where in step (c) the weak organic acid or salt thereof remains in contact with the fabric for at least 6 minutes.

14. The process according to claim 8 wherein the salt of the weak organic acid is selected from a sodium or potassium salt.

15. The process according to claim 2 comprising the additional step of rinsing the fabric with water at ambient temperature after the removal of all liquid.

16. The process according to claim 10 wherein the alkaline hydroxide is selected from sodium hydroxide, potassium hydroxide or ammonium hydroxide.

17. The process according to claim 2 wherein the weak organic acid or salt thereof is added at a rate of from 80 g to 120 g per litre.

18. The process according to claim 12 wherein the weak organic acid or salt thereof is added at a rate of from 2 g to 10 g per litre.

19. The process according to claim 12 wherein the weak organic acid or salt thereof is added at a rate of 5 g per litre.

20. The process according to claim 1, where in step (c) the weak organic acid or salt thereof remains in contact with the fabric for up to 60 minutes.

21. The process according to claim 2, where in step (c) the weak organic acid or salt thereof remains in contact with the fabric for up to 60 minutes.

22. The process according to claim 3, where in step (c) the weak organic acid or salt thereof remains in contact with the fabric for up to 60 minutes.

23. The process according to claim 13, where in step (c) the weak organic acid or salt thereof remains in contact with the fabric for up to 60 minutes.

* * * * *